US005793157A

United States Patent [19]

Takakura et al.

[11] Patent Number: 5,793,157

[45] Date of Patent: Aug. 11, 1998

[54] CATHODE STRUCTURE FOR A CATHODE RAY TUBE

[75] Inventors: Hiroshi Takakura, Mobara; Takashi Kono; Michihide Shibata, both of Chousei-gun; Yasuhiko Nonaka, Mobara, all of Japan

[73] Assignees: Hitachi, Ltd., Tokyo; Hitachi Electronic Devices Co., Ltd., Chiba-ken, both of Japan

[21] Appl. No.: 615,950

[22] Filed: Mar. 14, 1996

[30] Foreign Application Priority Data

Mar. 24, 1995 [JP] Japan ..... 7-065548
Aug. 29, 1995 [JP] Japan ..... 7-220611

[51] Int. Cl.[6] ..... H01J 1/20

[52] U.S. Cl. ..... 313/446; 313/346 R; 313/337; 313/270; 445/51

[58] Field of Search ..... 313/346 R, 346 DC, 313/337, 353, 339, 270, 446; 445/51

[56] References Cited

U.S. PATENT DOCUMENTS 4,990,823 2/1991 Swaving et al. ..... 445/51
5,289,076 2/1994 Lee ..... 313/346 R

FOREIGN PATENT DOCUMENTS 2-121235 5/1990 Japan ..... H01J 29/48
3-40331 2/1991 Japan ..... H01J 1/28

*Primary Examiner*—Sandra L. O'Shea
*Assistant Examiner*—Michael Day
*Attorney, Agent, or Firm*—Antonelli, Terry, Stout & Kraus, LLP

[57] ABSTRACT

A cathode ray tube has a cathode structure including a cathode body comprised of porous refractory metal impregnated with electron-emissive material, a metal cup for containing the cathode body therein, a metal sleeve having a closed end and mounting a heater therein, a cylindrical metal eyelet and a plurality of thin metal wires stretched across one end of the metal eyelet and suspending the metal cup and the metal sleeve concentrically with and in the cylindrical metal eyelet. The metal cup and the closed end of the metal sleeve are fixed with the plurality of thin metal wires interposed therebetween, and ends of the plurality of thin metal wires are welded to a metal flange formed at the one end of the metal eyelet. The metal cup can be welded to the closed end of the metal sleeve by an electron beam with the plurality of thin metal wires interposed therebetween. By virtue of providing the metal flange, the contact area for welding the metal wires is increased, thereby improving the welding strength and reliability.

11 Claims, 5 Drawing Sheets

CATHODE STRUCTURE FOR A CATHODE RAY TUBE

BACKGROUND OF THE INVENTION

The present invention relates to a cathode ray tube and a method of manufacturing the same and, more particularly, to a cathode ray tube employing a so-called impregnated cathode and a method of manufacturing the same.

A cathode ray tube employing the so-called impregnated cathode is known for its capability of displaying a high quality picture of very high brightness for a long period of time with a high electron beam current density.

A typical impregnated-cathode structure includes a cathode body of a pellet shape comprised of porous refractory metal, e.g. pressed tungsten (W) powder, impregnated with electron-emissive material, e.g. a mixture of barium oxide (BaO), calcium oxide (CaO) and alumina ($Al_2O_3$), a metal cup made of refractory metal, e.g. molybdenum (Mo), for containing the cathode body therein, a cylindrical metal sleeve having a closed end, made of refractory metal, e.g. molybdenum (Mo) for mounting a heater therein, and a plurality of thin metal suspension wires made of refractory metal, e.g. tungsten (W), and attached at one end of a metal eyelet (a cylindrical supporting member).

The bottom of the metal cup and the closed end of the metal sleeve are integrally welded with the plurality of metal suspension wires interposed therebetween, and the metal cup and the metal sleeve are usually suspended in and concentrically with the metal eyelet by means of the metal suspension wires.

The metal cup, the metal sleeve and the suspension metal wires in the conventional impregnated-cathode structure are welded and secured together by resistance welding, i.e., by pressing one of a pair of welding electrodes against the inner surface of the bottom of the metal cup and the other of the pair against the inner surface of the closed end of the metal sleeve, and by fusing portions of the bottom of the cup, the closed end of the sleeve and the wires to be welded together with a large current between the two welding electrodes by application of a high voltage across the welding electrodes.

Further, various techniques to improve operations of fixation of the cup and the sleeve with the thin metal wires interposed therebetween and fixation of the thin metal wires and the eyelet are disclosed by Japanese Patent Application Laid-Open Nos. Hei 2-121235 and Hei 3-40331, for example.

SUMMARY OF THE INVENTION

In a resistance welding of a metal cup, thin metal suspension wires, and a cylindrical metal sleeve, since all of them are made of refractory metals, it is necessary to heat the portions to welded to a high temperature. A large deformation occurs at the component elements at the welding section at a high temperature. Especially, in the welding section, the thin metal wires made of tungsten (W) cut into the bottom face of the metal cup made of molybdenum (Mo) and/or the bottom face of the cylindrical metal sleeve made of molybdenum (Mo). When the temperature of the welding section is reduced in order to avoid such deformation of the component elements, melting of the metals at the welding section becomes insufficient.

Further, during the process of resistance welding of the metal cup and the metal sleeve, since they are made of the refractory metals, the life of the welding electrodes will be short.

The eyelet, the sleeve and the metal cup and the like are concentrically assembled. As such, it is difficult to position these components relative to each other.

In order to solve the above problems, an object of the invention is to provide a cathode ray tube and its manufacturing method, employing an impregnated cathode structure which prevents deformation of the thin metal suspension wires during welding of the metal cup, the metal suspension wires and the cylindrical metal sleeve to the metal eyelet, which facilitates the positioning of the components, and which provides highly reliable welding.

According to a preferred embodiment of the invention, there is provided a cathode ray tube having a cathode structure including a cathode body comprised of porous refractory metal impregnated with electron-emissive material, a metal cup for containing the cathode body therein, a metal sleeve having a closed end and mounting a heater therein, a cylindrical metal eyelet and a plurality of thin metal wires stretched across one end of the metal eyelet and suspending the metal cup and the metal sleeve concentrically with and in the cylindrical metal eyelet, wherein the metal cup and the closed end of the metal sleeve are fixed with the plurality of thin metal wires interposed therebetween, and ends of the plurality of thin metal wires are fixedly welded to a metal flange formed at the one end of the metal eyelet.

According to another preferred embodiment of the invention, there is provided a cathode ray tube having a cathode structure including a cathode body comprised of porous refractory metal impregnated with electron-emissive material, a metal cup for containing the cathode body therein, a metal sleeve having a closed end and mounting a heater therein, a cylindrical metal eyelet and a plurality of thin metal wires suspending the metal cup and the metal sleeve concentrically with and in the cylindrical metal eyelet, wherein the metal cup and the closed end of the metal sleeve are welded by an electron beam with the plurality of thin metal wires interposed therebetween.

DETAILED DESCRIPTION OF THE PREFERRED EMBODIMENTS

Figure 7:
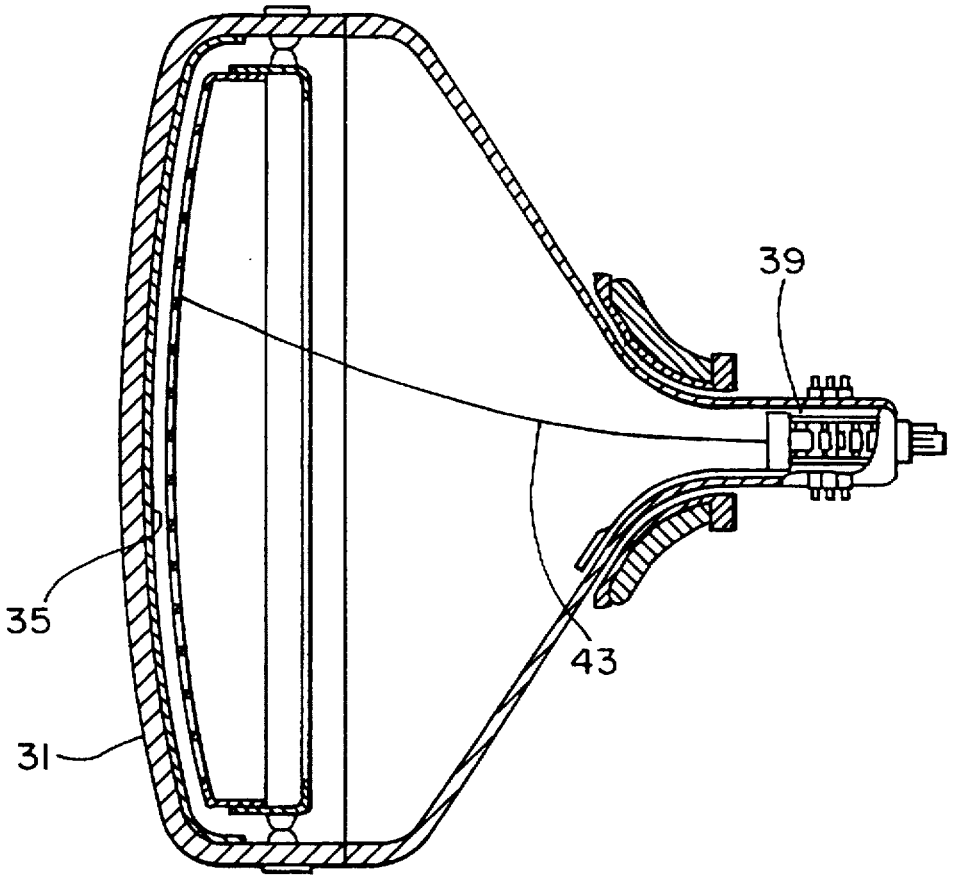
FIG. 7 is a schematic sectional view of an embodiment of a color cathode ray tube having a cathode structure according to the present invention.

FIG. 7 is a schematic sectional view of an embodiment of a color cathode ray tube having a cathode structure according to the present invention. Reference numeral 31 designates a panel section of an evacuated envelope, 35 a phosphor screen, 39 an electron gun, and 43 an electron beam. A cathode structure is disposed opposite a beam control grid electrode in the electron gun 39.

Figure 1:
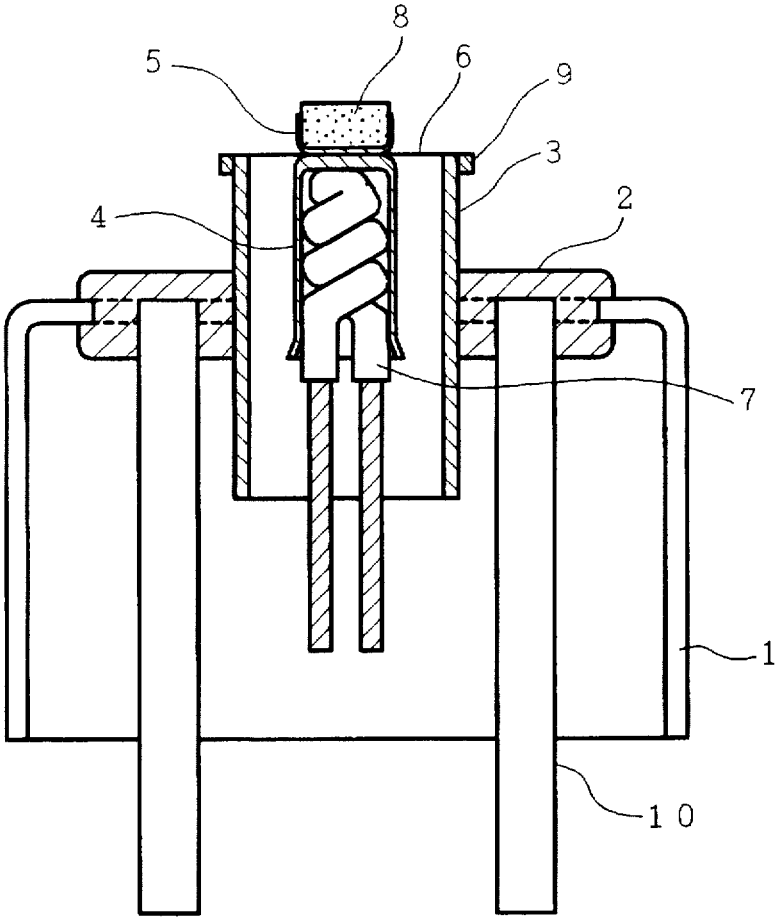
FIG. 1 is a sectional view showing an embodiment of a cathode structure for use in a cathode ray tube according to the invention.

FIG. 1 is a sectional view showing an embodiment of a cathode structure incorporated in a cathode ray tube according to the invention.

In FIG. 1, a cylindrical eyelet 3 is attached to a cylindrical supporting member 1 through crystallized glass 2. The supporting member 1 is made of, for example, Fe-Ni. The eyelet 3 is a cylinder made of, for instance, Fe-Ni-Co. Pin members 10 are embedded in the crystallized glass 2.

In the eyelet 3, a sleeve 4 and a cup 5 are disposed concentrically with the eyelet 3 and are welded to join a closed end of the sleeve 4 and a bottom of the cup 5 with thin metal suspension wires 6 made of, for example, Re-W interposed therebetween.

The sleeve 4 is made of, for example, Mo and is closed at one end thereof for mounting a heater 7 therein.

The cup 5 is made of, for example, Mo and is formed to contain cathode body 8 therein.

The sleeve 4 and cup 5 welded together are suspended in the eyelet 3 by the thin metal wires 6. With suspension by the thin metal wires 6, heat conduction from the heater 7 to the eyelet 3 is avoided as much as possible and the heat from the heater is effectively conducted toward the cup 5 containing the cathode body 8.

The cathode body 8 is composed of a pellet of a porous matrix impregnated with an electron-emissive material made of alkaline earth metal oxide. As for a method of manufacturing the pellet, W powder having mean particle size of 6 μm are pressed into a cylinder shape of about 1.0 mm in outside diameter and of about 0.55 mm in thickness and are sintered in vacuum at a high temperature above 1900° C. to form the porous matrix. The matrix in this case has 20% porosity. A mixture of BaO, CaO, $Al_2O_3$ in a mole ratio of 4:1:1 as electron-emissive material is melted and impregnated into the matrix. Excessive electron-emissive material overflowing from pores of the matrix are removed by washing out in pure water, thereby completing the pellet.

The thin metal wires 6 are fixed to the eyelet 3 as follows.

An annular metal member 9 is fitted around the outer periphery of the open end of the eyelet 3 to form a flange. The thin metal wires 6 are welded to and buried into the annular member 9.

Namely, the thin metal wires 6 are supported across the eyelet 3 through the annular member 9.

In such a construction, the annular member 9 is fixed at the open end of the eyelet 3 enabling a circumferential contact between them, and the thin metal wires 6 are welded to and embedded into the annular member 9 by a laser beam.

By providing the annular member 9, a flange section is formed and increases the contact area between the thin metal wires 6 and the annular member. A sufficient welding strength can consequently be obtained by laser welding at the contact area.

The thin metal wires 6 are welded enough to be embedded into the annular member, and reliability of the welding can be improved.

Thus, the component members can be reliably assembled without using resistance welding.

Figure 2:
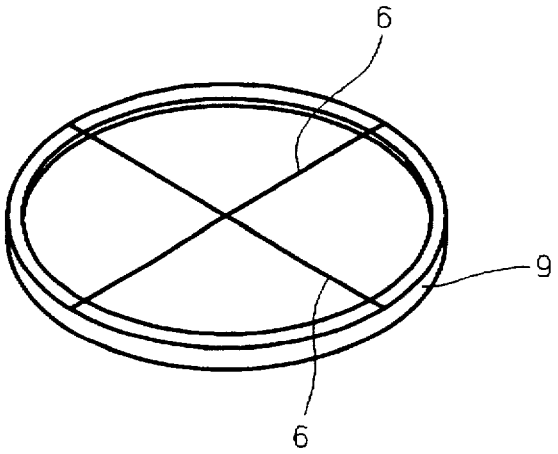
FIG. 2 is a perspective view showing the details of an annular metal member used for a cathode structure for use in a cathode ray tube according to the invention.

FIG. 2 is a perspective view showing an arrangement of the thin metal wires 6 and the annular member 9 (hereinafter referred to as ring 9 also). The two thin metal wires 6 are disposed so as to cross each other at the center of the ring 9, and each of the ends of the thin metal wires 6 is laser welded to the end face of the ring 9.

An embodiment of a manufacturing method of making the cathode structure of such a construction will be described with reference to FIGS. 3A to 3C.

Figure 3A:
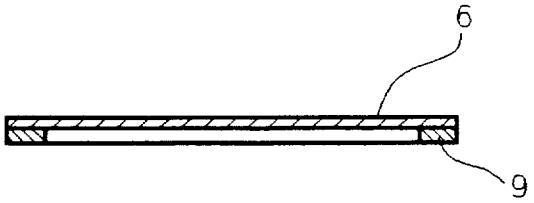
FIGS. 3A to 3C are diagrams of steps showing an embodiment of a method of manufacturing a cathode structure for use in a cathode ray tube according to the invention respectively.

Step 1 (FIG. 3A)

The two thin metal wires 6 are disposed so as to cross each other across the top surface of the ring 9 made of, for example, permalloy as shown in FIG. 2, and the thin metal wires 6 are tensed sufficiently in the axial directions of the respective thin metal wires.

This is because improvement in the reliability was confirmed in the laser welding between the thin metal wires 6 and the ring 9 as described hereinbelow.

In the state where the thin metal wires 6 are tensed, the thin metal wires 6 are pressed against the ring 9 and a laser beam is irradiated to the pressed section, thereby welding the thin metal wires 6 to the ring 9.

The thin metal wires 6 are welded to the ring 9 by irradiating a laser beam onto the weld point while the thin metal wires 6 are tensed across the open end of the ring 9 and the weld points thereof are pressed against the ring 9.

It is also confirmed that pressing the thin metal wires 6 against the ring 9 improves the reliability in of the laser welding.

The laser welding under this condition buries the thin metal wires into the ring.

The thin metal wires 6 are pressed against the ring 9 with a jig or the like (not shown), pressing can be also performed for each welding operation at every weld point or can be performed at all weld points at all times.

Figure 3B:
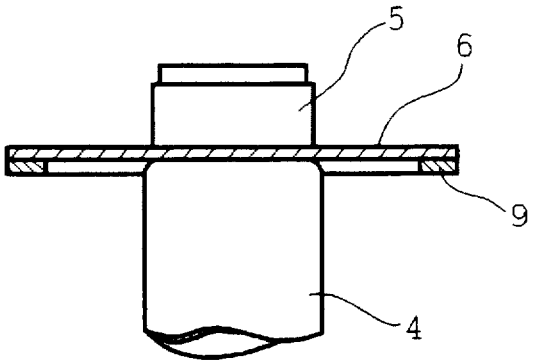

Step 2 (FIG. 3B)

The cup 5 is disposed on one side of the thin metal wires 6 stretched across the ring 9 and the sleeve 4 is disposed on the other side with the bottom of the cup 5 and the closed end of the sleeve 4 facing each other, and a laser beam is irradiated onto the contacting surfaces of them to weld the cup 5 and sleeve 4 with the thin metal wires 6 interposed therebetween.

In this case, it is confirmed that the reliability of the laser welding is improved by applying brazing solder made of, for example, Ru-Mo between the cup 5 and sleeve 4 beforehand.

The fixation means of the cup 5 and sleeve 4 is not always limited to the laser welding mentioned above. A similar effect is obtained by ion beam (EB) welding without brazing solder applied.

Figure 3C:
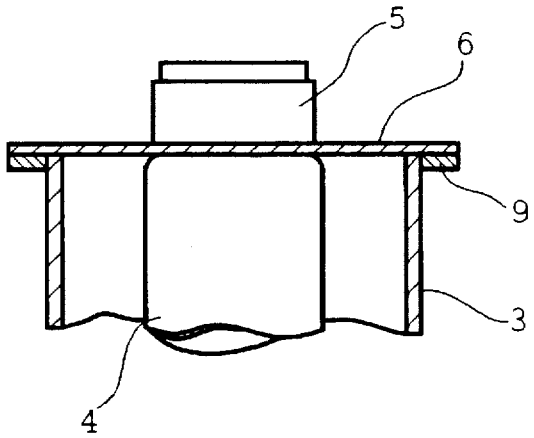

Step 3 (FIG. 3C)

The eyelet 3 is fitted into the ring 9 and a laser beam is irradiated to the fitted section to weld them.

In such a construction, the thin metal wires 6 are welded to the almost flatly formed surface of the ring 9 only and the thin metal wires 6 can be easily positioned relative to the ring 9.

The thin metal wires 6 are initially stretched across the ring 9, and then the eyelet 3 is fitted into the ring 9 to weld them together as mentioned above. By virtue of this arrangement, the positioning of the elements can be greatly facilitated.

The reliability of the laser welding is improved by welding the thin metal wires 6 to the ring 9 while the thin metal wires 6 are tensed in the axial directions of the thin metal wires. This cathode structure prevents variations in a beam cutoff voltage which could otherwise occur due to variations in a spacing between a cathode and a beam control grid electrode opposite the cathode caused by loosening of the thin metal wires 6.

The reliability of the assembly can be consequently improved and the positioning can be facilitated.

Although the ring 9 has been fitted around the outer periphery of the eyelet 3 in the foregoing embodiment, it will be obviously understood that it can be fitted into the inner periphery of the eyelet 3.

Figure 4:
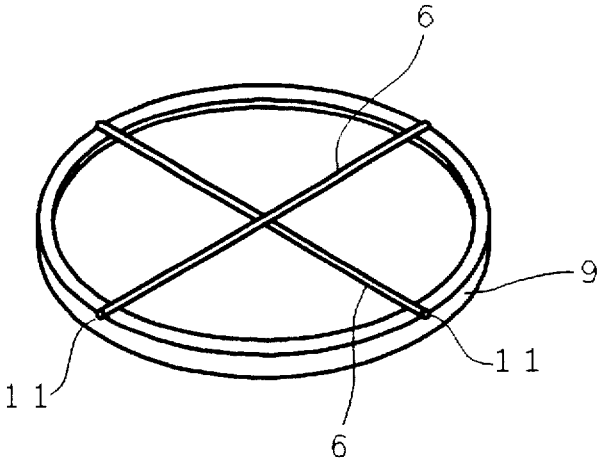
FIG. 4 is a perspective view showing an example of improvement over the annular metal member shown in FIG. 2.

As shown in FIG. 4, when slots 11 are formed in the surface of the ring 9 forming the flange section for fitting the thin metal wires 6 therein, positioning of the thin metal wires 6 is facilitated and the reliability of the welding of the thin metal wires 6 is improved because the thin metal wires are sufficiently embedded into the ring 9.

Figure 5:
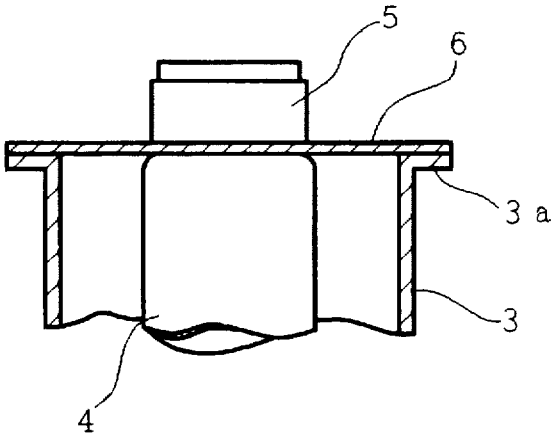
FIG. 5 is a sectional view showing a modification example of the eyelet shown in FIG. 1.

In the foregoing embodiment the flange section is formed by fitting the ring 9 formed separately from the eyelet 3 outside or inside the eyelet 3. As shown in FIG. 5, a flange section 3*a* and the eyelet 3 can be integrally formed by press-forming, the contact area between the flange section 3*a* and the thin metal wires 6 increases, and therefore reliable welding can be obtained.

Figure 6:
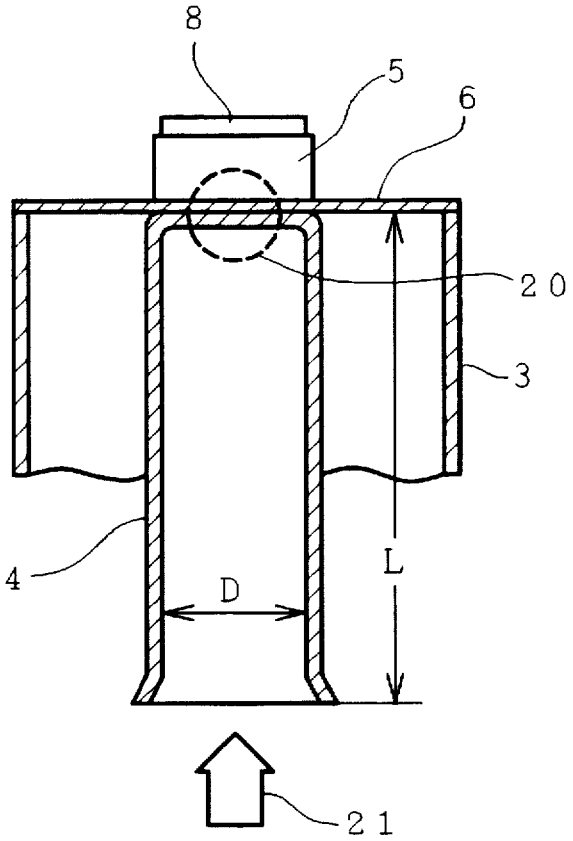
FIG. 6 is a sectional view of an arrangement of components to be welded by an electron beam in manufacturing an impregnated cathode structure for use in a cathode ray tube according to the invention.

FIG. 6 is a sectional view showing another embodiment of the cathode structure incorporated in the cathode ray tube according to the invention. A detailed description of portions similar to those in FIG. 1 is omitted here.

The cathode body 8 is housed in the metal cup 5 and the metal sleeve 4 is adapted for mounting the heater 7 therein. A plurality of thin metal wires 6 are radially stretched across and connected to one end of the metal eyelet 3. The metal cup 5 and the cylindrical metal sleeve 4 are disposed with the bottom of the metal cup 5 and the closed end of the cylindrical metal sleeve 4 facing each other with the plurality of the thin metal suspension wires 6 therebetween, and portions of their facing surfaces are welded by electron beam welding.

As shown in FIG. 1, an integral assembly of the metal cup 5, the cylindrical metal sleeve 4 and the thin suspension wires is suspended within the metal eyelet 3, and the heater 7 is mounted within the metal sleeve 4.

The impregnated-cathode structure of the above construction is installed into the cathode ray tube with other component elements, and, after a required process is applied, the cathode ray tube is completed.

With the completed cathode ray tube, when a current is supplied to the heater 7 in the impregnated-cathode structure and required operating voltages are applied to all the electrodes (not shown) in the cathode ray tube, an electron beam 43 is emitted from the cathode body 8 heated by the heater 7, and the emitted electron beam impinges on a phosphor screen 35 disposed on the inner side of the panel section 31, as shown in FIG. 7, thereby displaying a desired image on the phosphor screen. Since such an image displaying operation with the cathode ray tube is well known in the technical field, a more detailed description of the operation is omitted here.

The impregnated-cathode structure of the embodiment is characterized in that the resistance welding which is used as in the known impregnated-cathode structure is not used. Instead, electron beam welding is preferably used when the bottom of the metal cup 5 and the closed end of the cylindrical metal sleeve 4 are integrally joined with the plurality of thin metal suspension wires 6. Since the intensity adjustment or narrowing of the electron beam irradiated to the welding section can be facilitated by using the electron beam welding, deformation of the thin metal suspension wires 6 at the time of the welding can be minimized by finely controlling the metal melting temperature in the welding section. Also, the size of the welding section can be properly adjusted, so that the impregnated-cathode structure can be highly reliable at welded portions and avoid deformation of thin metal suspension wires 6 at the time of the welding.

FIG. 6 is a sectional view showing an arrangement for electron beam welding.

In FIG. 6, reference numeral 20 denotes a welding section and 21 indicates an electron beam. Component elements similar to those shown in FIG. 1 are designated by the same reference numerals as in FIG. 1.

An example of the manufacturing method of the impregnated-cathode structure according to the invention will now be described with reference to FIG. 6.

First, tungsten (W) powder having a mean particle size of about 6 μm is pressed into a cylinder body whose outer diameter is about 1.0 mm and whose thickness is about 0.55 mm. The cylinder body is sintered in a vacuum at a temperature above 1900° C. to produce a porous metal pellet of about 20% porosity. The porous metal pellet is impregnated with the melted electron-emissive material made up of a mixture of barium oxide (BaO), calcium oxide (CaO) and alumina ($Al_2O_3$) in a mole ratio of 4:1:1, and excessive electron-emissive material overflowing from pores of the porous metal pellet is washed out in pure water, thereby forming the cathode body 8.

A plate made of molybdenum (Mo) having a thickness of 30 μm is pressed into a metal cup 5 having an inner diameter of about 1.0 mm and height of about 0.5 mm. Subsequently, the cathode body 8 is inserted into and fixed in the metal cup 5. A plate made of molybdenum (Mo) having 0.1 mm thickness is pressed into a cylindrical metal sleeve 4 having a closed end, and the cylindrical metal sleeve 4 is blackened. Further, the cylindrical metal eyelet 3 is formed and a plurality of thin metal suspension wires 6 of tungsten (W) of a diameter of 30 μm are welded radially across one end of the metal eyelet 3.

An electron beam welding machine is prepared. As shown in FIG. 6, thin metal suspension wires 6 crossing each other are placed between the bottom of the metal cup 5 containing the cathode body 8 and the closed end of the blackened cylindrical metal sleeve 4, and are positioned properly relative to the metal cup 5 and the metal sleeve 4. The electron beam 21 from the electron beam welding machine is irradiated onto the welding section 20 in the closed end of the metal sleeve 4 from the open end of the metal sleeve 4, to weld together the bottom of the metal cup 5, the closed end of the metal sleeve 4 and the thin metal suspension wires 6 and to suspend the integral assembly of the metal cup 5 and the metal sleeve 4 in the metal eyelet 3.

The metal eyelet 3 suspending the integrally assembled metal cup 5 and metal sleeve 4 therein is fitted centrally in the crystallized glass support 2 having a cylinder member 1 and pin members 10 as shown in FIG. 1. Subsequently, the heater 7 is mounted in the metal sleeve 4, thereby completing the impregnated-cathode structure.

The manufacturing method of the impregnated-cathode structure according to the embodiment is characterized by employing electron beam welding in joining the metal cup 5 and the metal sleeve 4 together with the plurality of thin metal suspension wires 6 therebetween. In case of electron beam welding, since the intensity adjustment or narrowing of the electron beam 21 to be irradiated to the welding section can be facilitated, the temperature for melting metals in the welding section 20 can be finely controlled, so that the deformation of the thin metal suspension wires 6 at the time of the welding can be minimized and the size of the welded portions 20 can be also properly adjusted. The impregnated-cathode structure of high reliability can be manufactured without deformation of the thin metal suspension wires 6 at the time of the welding.

In an example of the dimension of the metal sleeve 4 shown in FIG. 6, the inner diameter D is 1 mm and the length L is 2.3 mm.

The bottom of the metal cup, the plurality of thin metal suspension wires, and the closed end of the cylindrical metal sleeve are welded by an electron beam, and since the depth of focus of the electron beam is large, the beam diameter and the beam intensity of the electron beam can be adjusted accurately at the time of the electron beam welding, to obtain a desired area to be welded in the end of the metal sleeve or to control the degree of the metal melting in the welding section. Thus, there is an advantage that an impregnated-cathode structure which is not accompanied by the deformation of the thin metal suspension wires at the time of the welding can be obtained. Also, since electron beam welding can be inexpensively performed, an inexpensive impregnated-cathode structure consequently can be obtained.

What is claimed is:

1. A cathode ray tube comprising:

a cathode structure including a cathode body comprised of porous refractory metal impregnated with electron-emissive material;

a metal cup for containing said cathode body therein;

a metal sleeve having a closed end and mounting a heater therein; and a cylindrical metal eyelet and a plurality of thin metal wires stretched in one plane across one end of said metal eyelet and suspending said metal cup and said metal sleeve concentrically with and in said metal eyelet, wherein a bottom of said metal cup and said closed end of said metal sleeve are fixed with said plurality of thin metal wires interposed therebetween, and ends of said plurality of thin metal wires are fixedly welded to a metal flange, extending radially and perpendicularly to a longitudinal axis of said cathode ray tube and formed at said one end of said metal eyelet.

2. A cathode ray tube according to claim 1, wherein said metal flange is integrally formed with said one end of said metal eyelet.

3. A cathode ray tube according to claim 1, wherein said metal flange is an annular metal member formed separately from and fitted outside or inside said one end of said metal eyelet.

4. A cathode ray tube according to claim 1, wherein said metal flange is formed with slots for fitting said ends of said plurality of thin metal wires therein at weld points thereof.

5. A cathode ray tube according to claim 1, wherein said plurality of thin metal wires are fixed to said metal flange by laser welding.

6. A cathode ray tube according to claim 1, wherein said metal cup and said closed end of said metal sleeve are fixed by electron beam welding with said plurality of thin metal wires interposed.

7. A cathode ray tube according to claim 1, wherein said metal sleeve and said metal cup with said plurality of thin metal wires interposed therebetween are welded by an electron beam and said plurality of thin metal wires and said metal flange are welded by a laser beam.

8. A cathode ray tube having a cathode structure comprising:

a cathode body comprised of porous refractory metal impregnated with electron-emissive material;

a metal cup for containing said cathode body therein;

a metal sleeve having a closed end and mounting a heater therein;

a cylindrical metal eyelet; and a plurality of thin metal wires stretched in one plane across one end of said metal eyelet and suspending said metal cup and said metal sleeve concentrically with and in said cylindrical metal eyelet, a bottom of said metal cup and said closed end of said metal sleeve being welded by an electron beam with said plurality of thin metal wires interposed therebetween.

9. A cathode ray tube comprising:

a cathode structure including a cathode body comprised of porous refractory metal impregnated with electron-emissive material;

a metal cup for containing said cathode body therein;

a metal sleeve having a closed end and mounting a heater therein;

a cylindrical metal eyelet and a plurality of thin metal wires stretched in one plane across one end of said metal eyelet and welded to said cylindrical metal eyelet for suspending said metal cup and said metal sleeve concentrically with and in said metal eyelet, wherein a bottom of said metal cup and said closed end of said metal sleeve are fixed with said plurality of thin metal wires interposed therebetween; and means for increasing the contact area in a direction perpendicular to a longitudinal axis of the cylindrical metal eyelet for welding the ends of said plurality of thin metal wires at said one end of said metal eyelet, said contact area at said one end of said metal eyelet being greater than an area of said cylindrical metal eyelet at a cross-section of said metal eyelet taken in said direction perpendicular to the longitudinal axis of the cylindrical metal eyelet at a location of said metal eyelet other than said one end.

10. A cathode ray tube according to claim 9, wherein said means for increasing the contact area for welding comprises a metal flange which is integrally formed with said one end of said metal eyelet.

11. A cathode ray tube according to claim 10, wherein said metal flange is an annular metal member formed separately from and fitted outside or inside said one end of said metal eyelet.

* * * * *